United States Patent [19]

Tikhonovich et al.

[11] Patent Number: 4,929,416

[45] Date of Patent: May 29, 1990

[54] CAST STEEL

[76] Inventors: Vadim I. Tikhonovich, ulitsa N.Uzhvy 4V, kv. 63, Kiev; Vladimir D. Pavljuk, pereulok Parkhomenko, 8a, Asbest; Bertold B. Vinokur, ulitsa Komsomolskaya, 3, kv. 38, Kiev; Stanislav E. Kondratjuk, ulitsa L.Pervomaiskogo, 3, kv. 15, Kiev; Georgy G. Lutsenko, ulitsa Borschagovskaya, 46/1, kv. 27, Kiev; Vladimir K. Edemsky, ulitsa Ushakova, 12, kv. 156, Kiev; Vladimir B. Kiselev, ulitsa Chigorina, 49, kv. 77, Kiev; Nikolai M. Karasev, ulitsa Plekhanova, 26; Anatoly K. Myakishev, ulitsa Mira, 4. kv. 52, both of Asbest, all of U.S.S.R.

[21] Appl. No.: 348,495

[22] PCT Filed: Aug. 25, 1987

[86] PCT No.: PCT/SU87/00092

§ 371 Date: Apr. 7, 1989

§ 102(e) Date: Apr. 7, 1989

[87] PCT Pub. No.: WO89/01987

PCT Pub. Date: Mar. 9, 1989

[51] Int. Cl.[5] ..... C22C 38/38

[52] U.S. Cl. ..... 420/12; 420/15; 420/56; 420/40; 420/74

[58] Field of Search ..... 420/12, 15, 56, 40, 420/74

[56] References Cited

FOREIGN PATENT DOCUMENTS 55-122858 9/1980 Japan ..... 420/12

60-248869 12/1985 Japan ..... 420/56

*Primary Examiner*—Deborah Yee

*Attorney, Agent, or Firm*—Burgess, Ryan & Wayne

[57] ABSTRACT

Cast steel has the composition (% by mass)

| | |
|---|---|
| carbon | 1.6–3.0 |
| silicon | 1.2–1.6 |
| manganese | 11.0–15.0 |
| chromium | 9.0–10.8 |
| cerium | 0.001–0.2 |
| vanadium | 0.15–0.3 |
| titanium | 0.05–0.3 |
| aluminium | 0.05–0.15 |
| boron | 0.005–0.015 |
| iron | the balance. |

The steel according to the present invention is intended for the manufacture of articles, operating under conditions of an intensive shock-abrasive wear and high contact loads of a shock character.

3 Claims, No Drawings

CAST STEEL

FIELD OF THE ART

The present invention relates to metallurgy, and, more specifically, to cast steel, which can be used for the manufacture of cast parts of ore-dressing machines, jaw-type, cone, rotary, and hammer crushers, linings of ore discharging chutes, grinding mills and other members of crushing-grinding and metallurgical equipment, operating under conditions of an intensive shock-abrasive wear with high contact loads of a shock character.

Prior Art

Known in the art is wear-resistant pig iron /SU, A, 393350/ containing /% by mass/:

| | |
|---|---|
| carbon | 2.5–3.8 |
| silicon | 1.1–3.5 |
| manganese | 5.5–12.0 |
| chromium | 1.5–4.0 |
| boron | 0.05–0.3 |
| titanium | 0.1–0.2 |
| iron | the balance. |

This pig iron can be employed for the manufacture of parts operating under abrasive wear conditions.

Said pig iron, however, is characterized by the presence of silicide segregation /mostly at the grain boundaries/ and large-size inclusions of hypereutectic carbides because of the high content of carbon and silicon, sharply lowering its impact elasticity and making the metal more brittle. In this connection it cannot be employed for the production of parts operating under shock-abrasive wear conditions.

Known in the art is also an alloy /SU, A, 498350/, which is used for the same purpose and contains /% by mass/:

| | |
|---|---|
| carbon | 1.6–3.0 |
| silicon | 0.15–2.0 |
| manganese | 5.0–15.0 |
| chromium | 5.0–12.0 |
| boron | 0.1–0.5 |
| titanium | 0.2–1.0 |
| iron | the balance. |

This alloy is sufficiently wear-resistant under abrasive wear conditions in the presence of impact and contact pressures.

However, a considerable amount of large-size carbides and borides as eutectic components present in the structure of the alloy (even in the case of a uniform distribution thereof), as well as the formation of large-size primary grains significantly lower the level of its impact elasticity, thus resulting in a rapid destruction of castings.

Known in the art is a wear-resistant cast steel /SU, A, 587170/, containing /% by mass/:

| | |
|---|---|
| carbon | 2.5–3.2 |
| chromium | 9.0–10.8 |
| silicon | 1.2–2.4 |
| manganese | 11.0–15.0 |
| cerium | 0.001–0.2 |
| vanadium | 0.15–0.3 |
| iron | the balance. |

This steel can be employed in the production of heavy-duty wear-resistant members of metallurgical and mining equipment.

However, the presence of a hardening phase of $M_7C_3$ type, which has an elongated shape as needles and a considerable length of interphase boundaries in the steel structure determines a low level of its impact elasticity (not more than 0.064 $J/m^2$) and nonuniformity of wear of parts, that depends on the angle at which the elongated carbides are disposed to the plane of wear.

DISCLOSURE OF THE INVENTION

It is an object of the present invention to provide a cast steel featuring a high wear-resistance under the conditions of a shock-abrasive wear at high contact loads of an impact character and having a high impact elasticity, while retaining sufficiently high mechanical and casting parameters.

This object is accomplished by providing a cast steel, containing carbon, silicon, manganese, chromium, cerium, vanadium and iron, which, according to the present invention, additionally contains titanium, aluminium, and boron at the following ratio of the components /% by mass/

| | |
|---|---|
| carbon | 1.6–3.0 |
| silicon | 1.2–1.6 |
| manganese | 11.0–15.0 |
| chromium | 9.0–10.8 |
| cerium | 0.001–0.2 |
| vanadium | 0.15–0.3 |
| titanium | 0.05–0.3 |
| aluminium | 0.05–0.15 |
| boron | 0.005–0.015 |
| iron | the balance. |

The steel according to the present invention is characterized by a homogeneous austenitic structure with a hardening disperse phase in the form of carbides, carbonitrides, and the like, which is uniformly distributed within the matrix volume thus imparting to the steel a high wear-resistance in the presence of dynamic loads, a high impact elasticity and stability of mechanical parameters under exploitation conditions.

In the manufacture of thin-wall castings, to ensure a high crack-resistance it is advisable to employ a cast steel which has the following composition /% by mass/:

| | |
|---|---|
| carbon | 1.6–2.0 |
| silicon | 1.2–1.4 |
| manganese | 11.0–15.0 |
| chromium | 9.0–9.5 |
| cerium | 0.001–0.2 |
| vanadium | 0.15–0.3 |
| titanium | 0.05–0.1 |
| aluminium | 0.05–0.1 |
| boron | 0.005–0.008 |
| iron | the balance. |

Proposed herein is also a cast steel which has the following composition /% by mass/:

| | |
|---|---|
| carbon | 2.4–3.0 |
| silicon | 1.4–1.6 |
| manganese | 12.9–15.0 |
| chromium | 9.8–10.8 |
| cerium | 0.1–0.2 |
| vanadium | 0.2–0.3 |
| titanium | 0.15–0.30 |

-continued

| | |
|---|---|
| aluminium | 0.1–0.15 |
| boron | 0.01–0.015 |
| iron | the balance. |

The above specified composition ensures an enhanced wear resistance under predominantly wear in the presence of insignificant impact loads.

BEST WAY OF CARRYING THE INVENTION INTO EFFECT

Casting of the steel according to the present invention is conducted by the known processes in electric furnaces with a basic lining, envisaging the use of a fresh charge in the form of both ferroalloys and wastes of carbon steel, high-manganese, and chromium steels.

A furnace is charged in the following order: waste and recycling materials are the main charge; ferrochromium is charged after smelting; ferromanganese; ferrovanadium; deoxidizers—silicon, aluminium; modifiers—titanium, boron, cerium.

Before casting the steel is held in the melting furnace under white (aluminous) synthetic slags.

According to the present invention steel can be produced also by processes of electric-slag and vacuumarc remelting.

The resulting cast steel has the following composition (% by mass):

| | |
|---|---|
| carbon | 1.6–3.0 |
| silicon | 1.2–1.6 |
| manganese | 11.0–15.0 |
| chromium | 9.0–10.8 |
| cerium | 0.001–0.2 |
| vanadium | 0.15–0.3 |
| titanium | 0.05–0.15 |
| aluminium | 0.05–0.15 |
| boron | 0.005–0.015 |
| iron | the balance. |

The carbon content of 1.6–30.0% by mass in the steel ensures the formation of optimal amount of small-size carbides of $M_7C_3$ and MC types in the structure. The carbon content of less than 1.6% by mass is not enough for the formation of a carbide phase in the desired amount, of the desired type and disposition in the matrix. The carbon content of more than 3.0% by mass is undesirable, because it results in the formation of large-size acicular hypereutectic carbides, which sharply lower the impact elasticity.

Silicon content of 1.2–1.6% by mass is necessary for deoxidation of steel, provision of a good flowability in a liquid state and a more complete assimulation of cerium and boron. Silicon content of more than 1.6% by mass results in the formation of brittle silicides, which lead to intergrain destruction. Silicon content lower than 1.2% by mass provides no noticeable effect.

Manganese content of 11.0–15.0% by mass ensures the necessary level of parameters and austenitic base of steel.

Chromium content in steel of 9.0–10.8% by mass ensures the necessary level of parameters through alloying of austenite and formation of disperse carbides in the matrix.

Cerium and vanadium content in the steel of 0.001–0.2% by mass and 0.15–0.3% by mass respectively results in a smaller size of primary grains in the steel increasing its impact elasticity.

The main component of the steel is iron; in addition to the said alloying elements the steel also contains impurities (% by mass): sulphur to 0.03, phosphorus to 0.1, the total of the accompanying impurities (Cu, Ni, Ca) to 0.5.

To increase shock-abrasive wear-resistance and impact elasticity, 0.05–0.3% by mass of titanium is incorporated in the composition of the steel according to the present invention. Titanium introduced into the steel within the above-specified range facilitates diminution of eutectic carbides and purifies the grain boundaries from non-metallic inclusions. Preventing liberation of carbides, borides, and nitrides at the grain boundaries titanium hinders origination of intergrain brittleness under significant impact loads and increases shock-abrasive wear resistance of the alloy through the formation and uniform distribution of disperse carbides, borides and nitrides of the TiC, $TiB_2$, TiN type in the matrix volume and through improving the dislocation structure of the metal. In this case the steel comprises a matrix with liberation of the second phase (carbides, borides, nitrides), surrounded by stress fields in the matrix. Under shock loads the dislocations present in a cast steel begin to move (to slide). Interacting with stress fields present around the particles of the second phase, upon sliding and by-passing said particles, the dislocations form closed dislocation rings. With increasing number of dislocation rings surrounded by stress fields the pushing-through resistance of new sliding dislocations is increased - hardening of the matrix takes place.

At a titanium content below 0.05% the distribution of carbide, boride and carbonitride phases the hardening of the steel matrix is not achieved. A content of titaniumn of more than 0.3% by mass gives no noticeable increase of the shock-abrasive wear-resistance due to saturation of the matrix by hardening disperse particles and engrossment thereof. Engrossment of carbides through coagulation increases the distance between them, fixation of dislocations is weakened, and no increase of the matrix hardening is achieved.

Introduction of aluminium into the steel in an amount of 0.05–0.15% by mass provides a more complete assimilation of cerium and boron, and also hinders the growth of grain of alloyed austenite upon cooling of a casting in the high-temperature zone. Furthermore, aluminium is a technological additive, which is necessary for a deep deoxidation of steel. Aluminium forms disperse particles of AlN and $Al_2O_3$ compounds, diminishes the initial structure, and prevents migration of austenite grain boundaries. Decreasing aluminium content below 0.05% by mass makes no significant effect on inhibition of austenite grain growth, since the amount of disperse particles of AlN and $Al_2O_3$ is not high. Increasing aluminium content above said limit (0.15% by mass) is not expedient due to the formation of large particles of AlN in the form of film inclusions at the grain boundaries, which can no longer hinder their growth. As a result, the steel becomes more brittle, and its impact elasticity and wear-resistance are lowered.

Introduction of boron in an amount of 0.005–0.015% by mass provides hardening of the matrix through the formation, in its structure, of inclusions of cerium and titanium borides of the $MB_2$ type, which are very hard and wear-resistant compounds, present in the form of disperse particles increasing the wear-resistance. Furthermore, boron, acting as a surfactant, inhibits diffusion of phosphorus atoms to the grain boundaries, thus preventing the formation of a phosphide eutectics and intergrain brittle destruction upon impact loads.

An increase of boron content above 0.015 % by mass results in the formation of aggregates of borides (segregations) at the grain boundaries sharply lowering the impact elasticity and wear-resistance. A decrease in boron content below 0.005% by mass has no noticeable effect on the steel properties.

TABLE 1-continued

| | | Steel Nos. Chemical composition, % by mass | | | |
|---|---|---|---|---|---|
| 5 | 0.30 | 0.30 | 0.15 | 0.015 | the balance |
| 6 | 0.30 | 0.20 | 0.15 | 0.015 | the balance |

TABLE 2

| | | Steel Nos. Physico-mechanical parameters | | | | | | |
|---|---|---|---|---|---|---|---|---|
| | | Tensile strength MPa | Bending strength MPa | Hardness, HPC | Impact viscosity $a_h$, kg/cm$^2$ | Shock abrasive wear-resistance % | Fluidity, mm | Linear shrinkage |
| 1 | 2 | 3 | 4 | 5 | 6 | 7 | 8 | 9 |
| According to SU, A, 587170 | 1 | 29.6 | 44.8 | 27 | 0.68 | 100 | 451 | 1.95 |
| According to the present invention | 2 | 30.7 | 45.7 | 22 | 1.04 | 108 | 442 | 1.7 |
| | 3 | 30.4 | 46.3 | 25 | 1.92 | 157 | 448 | 1.82 |
| | 4 | 30.1 | 47.4 | 28 | 1.91 | 180 | 467 | 1.78 |
| | 5 | 29.8 | 48.2 | 30 | 1.54 | 148 | 482 | 1.76 |
| | 6 | 27.3 | 42.1 | 31 | 0.76 | 192 | 493 | 1.84 |

The steel according to the present invention, in comparison with the known wear-resistant steel (SU, A, 587170), under the same test conditions at substantially equal strength characteristics and sufficiently high plasticity is characterized by an increase of its shock-abrasive wear-resistance by 50–80% by mass and impact elasticity by 2.5–2.8 times without changes in the casting parameters (fluidity and linear shrinkage). These parameters make it possible to employ said steel for the production of large- and small-size shaped castings of a broad assortment: working members, parts and assemblies of crushing-grinding, mining, ore dressing and metallurgical equipment, operating under severe conditions of shock-abrasive wear in the presence of considerable contact loads of a shock character.

The high parameters of wear-resistance and impact elasticity of the steel according to the present invention result in a reduced consumption of the subject to wear replaceable units of mining and ore-dressing equipment; they also increase its reliability and extend its service life. The steel is characterized by a high crack-resistance upon casting. Thin-walled castings from this steel can be produced without increments.

There are no critical components in the composition of the steel according to the present invention.

For a better understanding of the present invention some examples of the chemical composition and parameters of the steel according to the present invention are given in tables 1 and 2 hereinbelow.

TABLE 1

| | | Steel Nos. Chemical composition, % by mass | | | | |
|---|---|---|---|---|---|---|
| | | C | Si | Mn | Cr | Ce |
| 1 | 2 | 3 | 4 | 5 | 6 | 7 |
| According to SU, A, 587170 | 1 | 2.79 | 1.30 | 12.50 | 9.50 | 0.012 |
| According to the present invention | 2 | 2.00 | 1.38 | 13.76 | 9.50 | 0.01 |
| | 3 | 1.60 | 1.20 | 11.00 | 9.00 | 0.001 |
| | 4 | 2.42 | 1.40 | 12.90 | 9.87 | 0.13 |
| | 5 | 3.00 | 1.60 | 15.00 | 10.80 | 0.20 |
| | 6 | 2.80 | 1.52 | 14.23 | 10.31 | 0.17 |

| | V | Ti | Al | B | Fe |
|---|---|---|---|---|---|
| 2 | 8 | 9 | 10 | 11 | 12 |
| 1 | 0.20 | — | — | — | the balance |
| 2 | 0.18 | 0.05 | 0.08 | 0.008 | the balance |
| 3 | 0.15 | 0.05 | 0.05 | 0.005 | the balance |
| 4 | 0.20 | 0.10 | 0.10 | 0.010 | the balance |

Industrial Applicability

The cast steel of the invention can be used for the manufacture of cast parts of ore-dressing machines, jaw-type, cone, rotary, and hammer crushers, linings of ore discharging chutes, grinding mills and other members of crushing-grinding and metallurgical equipment, operating under conditions of an intensive shock-abrasive wear with high contact loads of a shock character.

what we claim is:

1. A cast steel, having the composition (% by mass):

| | |
|---|---|
| carbon | 1.6–3.0 |
| silicon | 1.2–1.6 |
| manganese | 11.0–15.0 |
| chromium | 9.0–10.8 |
| cerium | 0.001–0.2 |
| vanadium | 0.15–0.3 |
| titanium | 0.05–0.3 |
| aluminium | 0.05–0.15 |
| boron | 0.005–0.015 |
| iron | the balance. |

2. A cast steel according to claim 1, having the composition in the following ratio (mass %):

| | |
|---|---|
| carbon | 1.6–2.0 |
| silicon | 1.2–1.4 |
| manganese | 11.0–15.0 |
| chromium | 9.0–9.5 |
| cerium | 0.001–0.2 |
| vanadium | 0.15–0.3 |
| titanium | 0.05–0.1 |
| aluminium | 0.05–0.1 |
| boron | 0.005–0.008 |
| iron | the balance. |

3. A cast steel according to claim 1, having the composition, % by mass:

| | |
|---|---|
| carbon | 2.4–3.0 |
| silicon | 1.4–1.6 |
| manganese | 12.9–15.0 |
| chromium | 9.8–10.8 |
| cerium | 0.1–0.2 |
| vanadium | 0.2–0.3 |
| titanium | 0.15–0.3 |
| aluminium | 0.1–0.15 |
| boron | 0.01–0.015 |
| iron | the balance. |

* * * * *

UNITED STATES PATENT AND TRADEMARK OFFICE

CERTIFICATE OF CORRECTION

PATENT NO. : 4,929,416

DATED : May 29, 1990

INVENTOR(S) : Tikhonovich, et al

It is certified that error appears in the above-identified patent and that said Letters Patent is hereby corrected as shown below:

Column 3, line 36: change "0.05-0.15" to --0.05-0.3-- line 41: change "1.6-30.0%" to --1.6-3.0--

Column 6, Table 2: change "HPC" to --HRC-- (line 1[illegible])

Table 2, line 12: change "shrinkage" to --shrinkage, %-

Table 2, line 17: change "1.7" to --1.77--

Signed and Sealed this

Third Day of November, 1992

*Attest:*

DOUGLAS B. COMER

*Attesting Officer*

*Acting Commissioner of Patents and Trademarks*